US010707031B2

(12) United States Patent
Da Mota Pais et al.

(10) Patent No.: US 10,707,031 B2
(45) Date of Patent: Jul. 7, 2020

(54) ELECTRICAL PUSHBUTTON SNAP SWITCH WITH MEANS FOR IDENTIFYING THE POSITION OF THE PUSHBUTTON AND/OR OF THE DRIVING MEMBER

(71) Applicant: C&K Components S.A.S., Dole (FR)

(72) Inventors: Mario Da Mota Pais, Brevans (FR); Laurent Kubat, Dole (FR)

(73) Assignee: C&K Components S.A.S., Dole (FR)

( * ) Notice: Subject to any disclaimer, the term of this patent is extended or adjusted under 35 U.S.C. 154(b) by 50 days.

(21) Appl. No.: 15/784,492

(22) Filed: Oct. 16, 2017

(65) Prior Publication Data

US 2018/0114655 A1 Apr. 26, 2018

(30) Foreign Application Priority Data

Oct. 24, 2016 (EP) ..... 16195270

(51) Int. Cl.

| | |
|---|---|
| ***H01H 9/16*** | (2006.01) |
| ***H01H 13/14*** | (2006.01) |
| ***H01H 13/30*** | (2006.01) |
| ***H01H 9/00*** | (2006.01) |
| ***H01H 13/22*** | (2006.01) |
| ***H01H 13/28*** | (2006.01) |
| *H01H 13/18* | (2006.01) |

(52) U.S. Cl.

CPC ..... *H01H 13/14* (2013.01); *H01H 9/0066* (2013.01); *H01H 9/167* (2013.01); *H01H 13/22* (2013.01); *H01H 13/28* (2013.01); *H01H 13/30* (2013.01); *H01H 13/18* (2013.01)

(58) Field of Classification Search

CPC ..... H01H 9/0066; H01H 9/16; H01H 9/167; H01H 1/14; H01H 13/14; H01H 13/22; H01H 13/28; H01H 13/40; H01H 13/506

See application file for complete search history.

(56) References Cited

U.S. PATENT DOCUMENTS 3,924,090 A * 12/1975 Chao ..... H01H 1/50 200/533

4,266,104 A 5/1981 Capel (Continued)

FOREIGN PATENT DOCUMENTS

| | | | |
|---|---|---|---|
| EP | 1223593 | A2 | 7/2002 |
| EP | 1263008 | A2 | 12/2002 |
| GB | 2177259 | A | 1/1987 |

*Primary Examiner* — Felix O Figueroa

(74) *Attorney, Agent, or Firm* — Fox Rothschild LLP

(57) ABSTRACT

A switch comprising having an actuation member in the form of a pushbutton with an actuating portion being arranged, when an external force is applied to the pushbutton, to be moved vertically relative to the housing between a pushbutton upper position and a pushbutton lower position, the pushbutton and a tilting driving member forming a movable mechanical assembly. An electrical switching portion generates signals representative of changes of position of the one and/or of the other of the two components of the movable assembly, the electrical switching portion including a sensing switch for sensing the changes of position of the pushbutton between its upper position and its lower position, and a detecting switch for detecting the changes of position of the tilting driving member between its upper position and its lower position.

20 Claims, 8 Drawing Sheets

(56) References Cited

U.S. PATENT DOCUMENTS

| | | | | |
|---|---|---|---|---|
| 4,388,503 | A * | 6/1983 | Penland | H01H 13/64 200/5 R |
| 9,837,225 | B2 * | 12/2017 | Grange | H01H 13/26 |
| 2014/0034462 | A1 | 2/2014 | Lee | |
| 2016/0163478 | A1 | 6/2016 | Grange et al. | |

* cited by examiner

ELECTRICAL PUSHBUTTON SNAP SWITCH WITH MEANS FOR IDENTIFYING THE POSITION OF THE PUSHBUTTON AND/OR OF THE DRIVING MEMBER

RELATED APPLICATIONS AND CLAIM OF PRIORITY

This patent document claims priority to European Patent Application number 16195270.0, filed Oct. 24, 2016, titled "Electrical Pushbutton Snap Switch with Means for Identifying the Position of the Pushbutton and/or of the Driving Member." The disclosure of the priority application is fully incorporated into this document by reference.

BACKGROUND

The present disclosure relates to an electrical switch, also known as a snap switch. Such an electrical snap switch is designed for selectively establishing a first conductive way between two conductive fixed contacts, or a second conductive way between two other conductive fixed contacts. The switch may include a housing, a pushbutton extending out of the housing and comprising a driving portion formed by an extension extending into the housing, the pushbutton being arranged, when an external force is applied to the pushbutton, to be moved relative to the housing between, a first pushbutton active position in which the first conductive way is established, and a second pushbutton active position in which the second conductive way is established.

According to a known design, a snap switch may include a conductive unit that is fixed with respect to the housing and that includes the fixed contacts, and a switching unit including a conductive swaying element, a first end of the conductive swaying element being pivotally engaged with the first conductive element, and the second end of the conductive swaying element being arranged to selectively electrically connect the first conductive fixed contact to either the second or the third conductive fixed contact, and a traction spring having a first end operatively connected to the housing and a second end secured to the swaying element, such that when the pushbutton is in the first upper pushbutton position, the spring is in a first spring position and the spring causes the swaying element to electrically connect a first pair of conductive fixed contacts, and when the pushbutton is moved to the second lower pushbutton position, the spring is moved to a second spring position and the spring causes the swaying element to also move to electrically connect a second pair of fixed contacts.

An example of such a switch is disclosed in U.S. Pat. No. 7,205,496, in which the spring is a helicoidally wounded traction spring and in which the pushbutton driving portion acts on the middle section of the spring.

An attempt to improve the working of such a snap switch is illustrated in U.S. Pat. No. 6,255,611, in which the switching unit is bistable between the first and second positions of the swaying element, in which the switch comprises a return spring that is disposed between the housing and the pushbutton, in which, when an external force applied to the pushbutton is removed, the pushbutton is returned back to its original the first active position by the return spring, and in which the traction spring has a first end connected to the driving portion of the pushbutton and a second end secured to the swaying element, so that when the pushbutton is in the first pushbutton position, the first end of the traction spring is in a first spring position, and when the pushbutton is moved to the second pushbutton position, the first end of the spring is moved to a second spring position.

According to such an arrangement, when an external force is applied to the pushbutton, the jointed end of the driving portion of the pushbutton and the elastic spring is forced to move downwards until it passes a critical line, at which point the swaying element is coupled with another conductive fixed contact to supply power or electrical signals.

According other designs disclosed in U.S. Patent Application Publication No. 2013/0068600, the swaying conductive element comprises sliding movable contacts that move in a vertical plane. The sliding contacts generate lower noises but the durability is affected due to repeated frictions between the electrical portions of contacts.

In order to improve such designs, reduce the number of components, simplify the design of the swaying conductive element, and provide with modularity concerning the number of switching conductive ways to be established or interrupted, a new design has been proposed in U.S. Patent Application Publication No. 2016/0163478, which discloses an electrical snap switch comprising a housing having a receiving portion, an actuation member in the form of a pushbutton comprising an actuating portion formed by an extension extending into the housing, the pushbutton being arranged, when an external force is applied to the pushbutton, to be moved vertically relative to the housing between a pushbutton upper position and a pushbutton lower position, at least a first pair of associated contact elements comprising a first fixed contact element provided in the receiving portion, and comprising a first movable contact element and that may come into contact with the first fixed contact element for establishing a first conductive way between the first movable contact element and the first fixed contact element, and a snap-action switching mechanism comprising a tilting driving member that is pivotally mounted with respect to the housing around an horizontal axis, and comprising a spring that is connected to a part of the driving member, and that cooperates with the actuating portion to move the driving member pivotally between an upper position and a lower position, the pushbutton and the tilting driving member forming a movable mechanical assembly.

Such snap switches are, for example, commonly used in the automotive industry for example for actuation of an electronic parking brake.

Consequently, there is a need to improve the reliability of operation of a snap switch of the above mentioned type, in particular to avoid discrepancies between the actuation of the switch and the actual operation of the switch.

SUMMARY

The present disclosure proposes an electrical snap switch including a housing having a receiving portion, an actuation member in the form of a pushbutton comprising an actuating portion formed by an extension extending into the housing, the pushbutton being arranged, when an external force is applied to the pushbutton, to be moved vertically relative to the housing between a pushbutton upper position and a pushbutton lower position. At least a first pair of associated contact elements includes a first fixed contact element provided in the receiving portion, and includes a first movable contact element that may come into contact with the first fixed contact element for establishing a first conductive way between the first movable contact element and the first fixed contact element. Also included is a snap-action switching mechanism including a tilting driving member that is pivotally mounted with respect to the housing around an horizontal axis, and including a spring that is connected to a part of the driving member and that cooperates with the actuating portion to move the driving member pivotally between an upper position and a lower position.

The pushbutton and the tilting driving member form a movable mechanical assembly, wherein for generating signals representative of changes of position of the pushbutton, the electrical snap switch includes a sensing switch for sensing the changes of position of the pushbutton between its upper position and its lower position. The sensing switch includes an actuator movable with the actuating portion and at least one elastically deformable conductive sensing blade, the actuator being adapted to act on the sensing blade. Additionally and/or alternatively, for generating signals representative of changes of position of the driving member, the electrical snap switch includes a detecting switch for detecting the changes of position of the tilting driving member between its upper position and its lower position. The detecting switch includes an activator movable with the tilting driving member and at least one elastically deformable conductive detecting blade, the activator being adapted to act on the detecting blade.

According to other aspects of the snap switch, under the action of the actuator, the sensing blade is movable between a rest position associated with the pushbutton upper position and an active position associated with the pushbutton lower position. Additionally, the change of position of the sensing blade provokes a change of state of a first switching way of the sensing switch, while the change of position of the sensing blade provokes, simultaneously or consecutively, a change of state of a first switching way, and a change of state of a second switching way of the sensing switch. Furthermore, the actuator is a cam shaped portion of the actuating portion. The sensing blade extends vertically and includes an upper free actuation portion for cooperation with the actuator, as well as a lower terminal end supported by the housing.

Under the action of the activator, the detecting blade is movable between a rest position associated with the tilting driving member upper position and an active position associated with the tilting driving member lower position. The change of position of the detecting blade provokes a change of state of a detecting switching way of the detecting switch. The detecting blade extends globally horizontally and includes a longitudinal activation portion for cooperation with the activator, as well as a terminal end supported by the housing.

The activator is a portion of a lower face of the tilting driving member, and the actuating portion of the push button is vertically and slidably guided with respect to the housing, along a vertical actuation axis. The tilting driving member is pivotally mounted with respect to the housing around a geometrical horizontal pivoting axis that is fixed with respect to the housing.

BRIEF DESCRIPTION OF THE FIGURES

Other characteristics and advantages of the disclosure will become apparent from reading the following detailed description, for an understanding of which reference should be made to the appended drawings in which.

DETAILED DESCRIPTION

In the description that follows, identical, similar or analogous components are designated by the same reference numbers.

As a non-limiting example, to assist in understanding the description and the claims, the terms vertical, horizontal, bottom, top, up, down, transversal, longitudinal, and so on will be adopted with reference to the L, V, T trihedron indicated in the Figures, and without any reference to the gravity.

The longitudinal axis is horizontal and is oriented from the front to the rear opposite ends of the switch.

In the illustrated embodiment, the design of the whole switch is symmetrical with respect to the vertical and longitudinal median plane.

Figure 1:
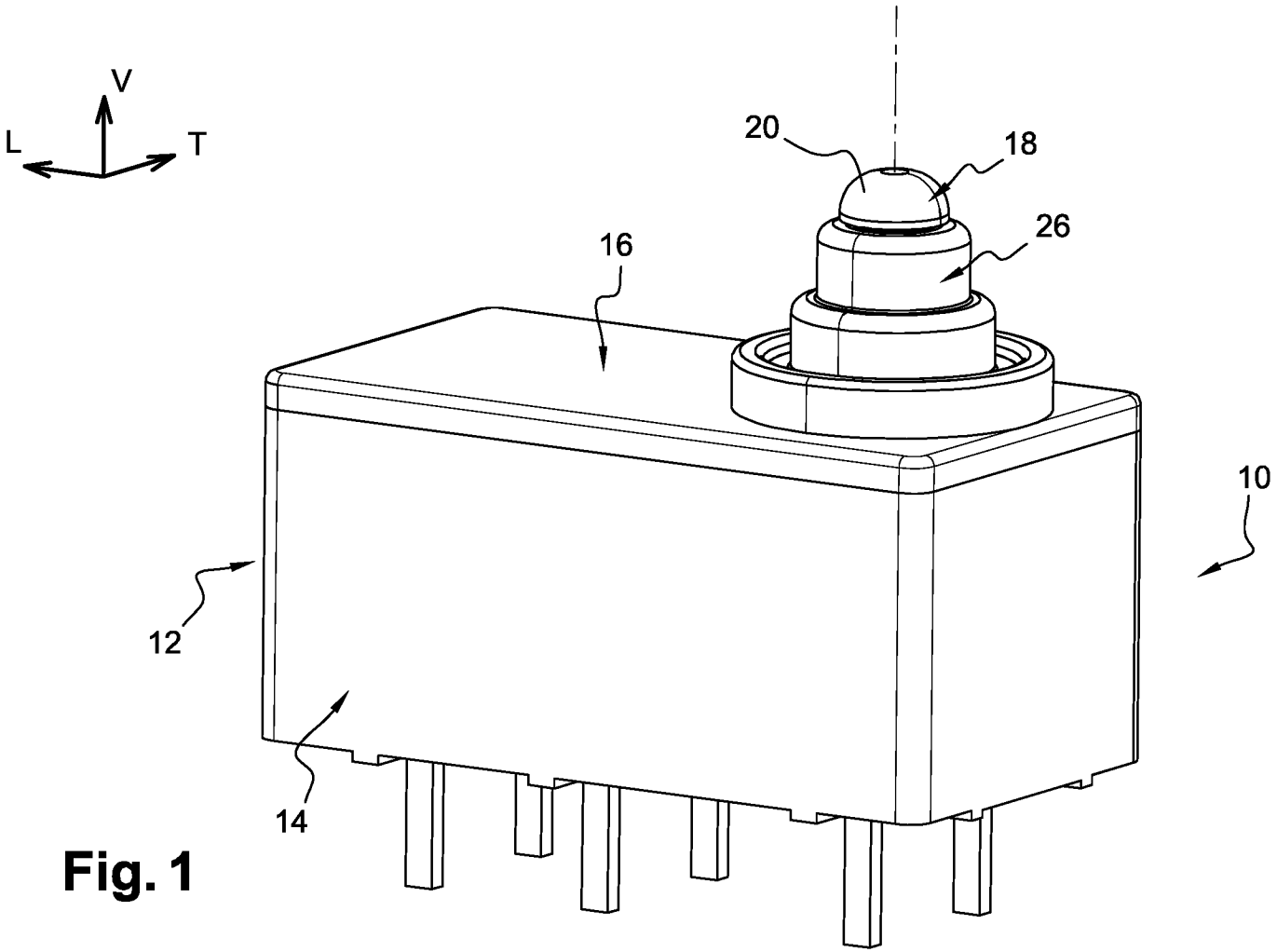
FIG. 1 is a top perspective view that illustrates an embodiment of a bistable snap switch according to the prior art.
Figure 2:
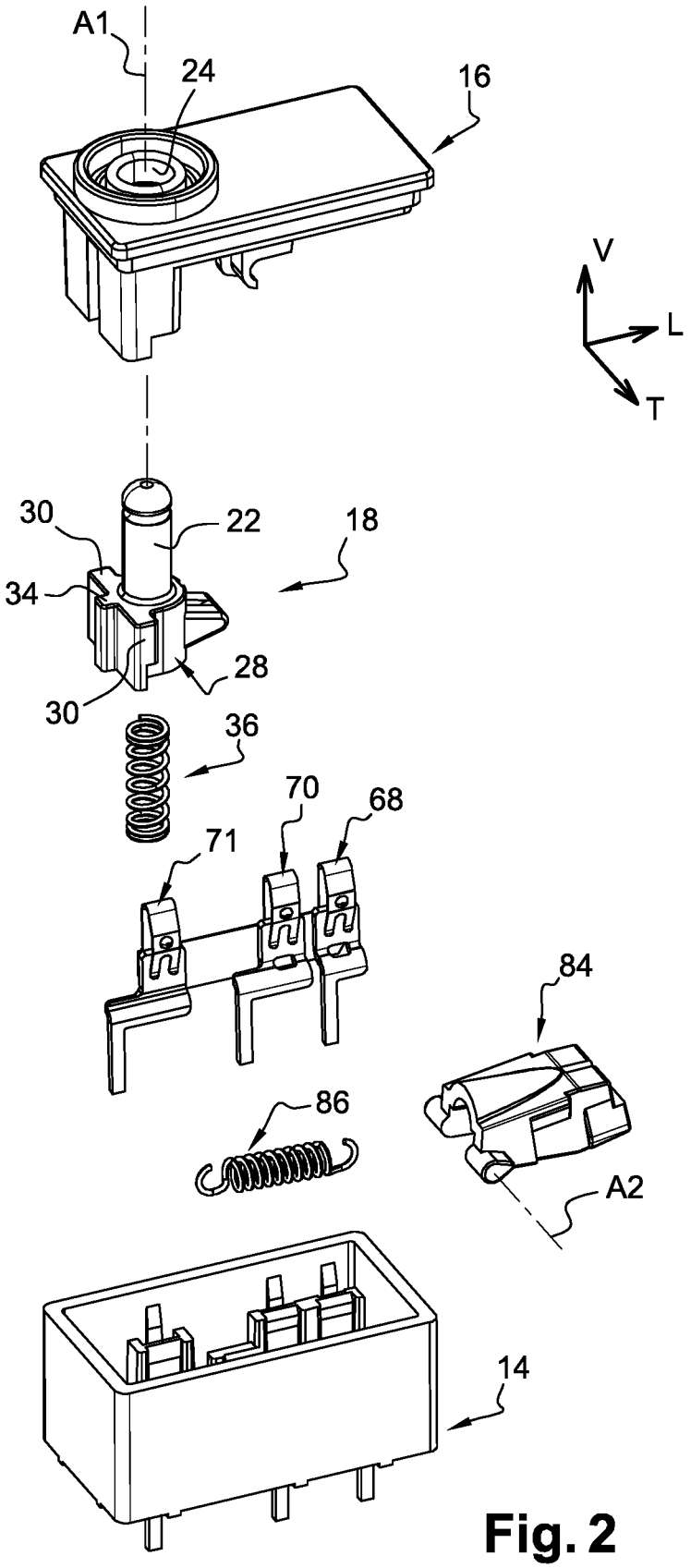
FIG. 2 is a perspective view similar to FIG. 1 showing some of the main components in an exploded view.

FIG. 1 shows an example of a snap switch such as the one disclosed in U.S. Patent Application Publication No. 2016/0163478.

According to this example, FIG. 1 illustrates a snap switch 10 having a housing 12, of rectangular parallelepipedic shape and made of a housing upper cover part 16 and a housing lower part or half 14—defining a receiving portion—made of molded plastics and that might be ultrasonic welded after mounting and assembly.

The switch 10 includes a movable mechanical assembly including a pushbutton 18 and a tilting driving member 84. The first component of the movable assembly is a vertically extending and displaceable pushbutton 18 having a free upper end 20 for receiving an actuation force. The main vertical upper stem 22 of the pushbutton 18 extends through a hole 24 of the housing upper cover part 16 in combination with a sealing boot 26. The pushbutton 18 is here, in a non-limiting manner, a plastic molded part comprising a lower actuating portion 28 that is an extension of the main vertical stem 22 and that is arranged and extends inside the housing 12.

The lower actuating portion 28 includes a pair of vertically and transversely extending lateral guiding wings 30 that are received in mating and complementary pairs of vertical grooves that are arranged in the upper cover part 16 of the housing 12. The push button and its actuating portion are thus vertically and slidably guided with respect to the housing 12, along a vertical actuation axis A1.

The switch 10 includes a return spring 36 that is disposed vertically between the lower part 14 of the housing 12 and the lower actuating portion 28 of the pushbutton 18. The return spring 36 is a vertically and helicoidally wound spring that is received in a pit 40 of the lower part 14 and having its upper end acting on an internal horizontal face 42 of the actuating portion 28.

Figure 3:
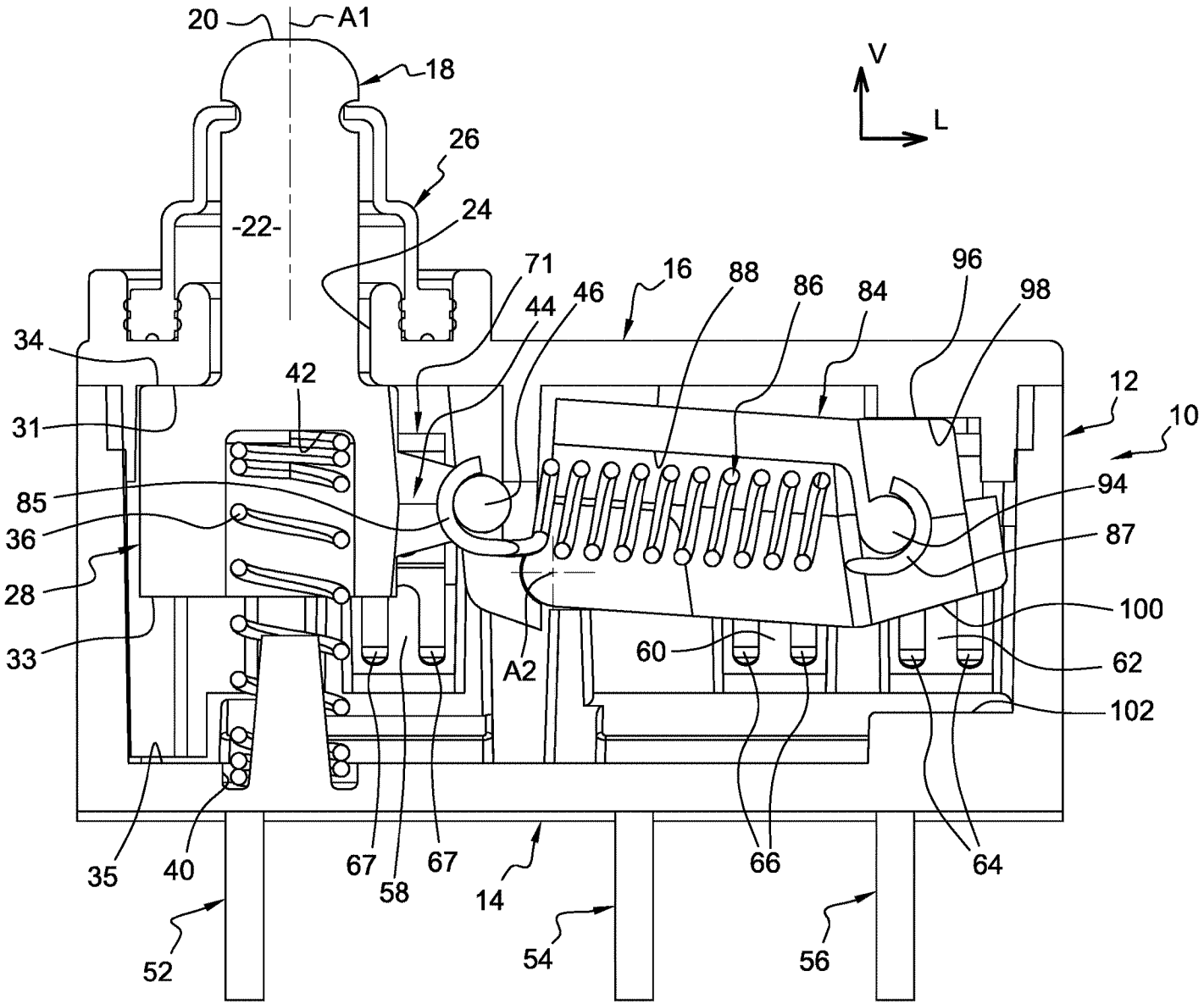
FIG. 3 is a cross-sectional view taken along a vertical and longitudinal median plane showing the components in their upper position.

The return spring 36 is mounted so as to be vertically compressed in such a way that, when an external force applied downwardly to the free upper end 20 of the pushbutton is removed, the pushbutton is returned back to its upper rest position (illustrated at FIG. 3) by the return spring 36. This upper rest position is defined by the cooperation of an upper face 34 of the actuating portion 28 with a lower facing face 31 of the upper cover part 16. Starting from this upper position (and by compressing the return spring 36), the pushbutton 18 can be pushed downwardly towards its extreme lower position that is defined by the cooperation of a lower face 33 of the actuating portion 28 together with a facing portion 35 of the lower housing part 14.

The lower actuating portion 28 comprises a vertically open slit 44. As it can be seen at FIG. 4, the slit 44 is delimited longitudinally by a transversal stem shaped portion 46 for constituting, in this example, a spring hooking portion. The pushbutton 18 is longitudinally arranged at one end of the housing 10 and the actuating portion 28 extends longitudinally towards the other opposite end of the housing 10, having its portion 46 oriented longitudinally towards the other opposite end.

The snap switch 10 includes a conductive unit 50 made of several conductive fixed contacts belonging to metallic fixed conductive pins made of a cut metal sheet. The conductive unit includes a pair of third conductive fixed contacts 52, each one including a fixed third upper contact zone 53, arranged inside the housing 12, in the form of a vertical and longitudinal contact plate. The two third upper contact plates 53 are transversely aligned in a vertical plane that is arranged longitudinally close to the pushbutton switch 18, between the axis A1 and the transversal stem shaped portion 46.

The conductive unit includes a pair of second conductive fixed contacts 54, each one including a second fixed upper contact zone 55, arranged inside the housing 12, in the form of a vertical and longitudinal contact plate. The two second upper contact planes 55 are transversely aligned in a vertical plane.

The conductive unit includes a pair of first conductive fixed contacts 56, each one including a first fixed upper contact zone 57, arranged inside the housing 12, in the form of a vertical and longitudinal contact plate. The two first upper contact plates 57 are transversely aligned in a vertical plane.

Figure 5:
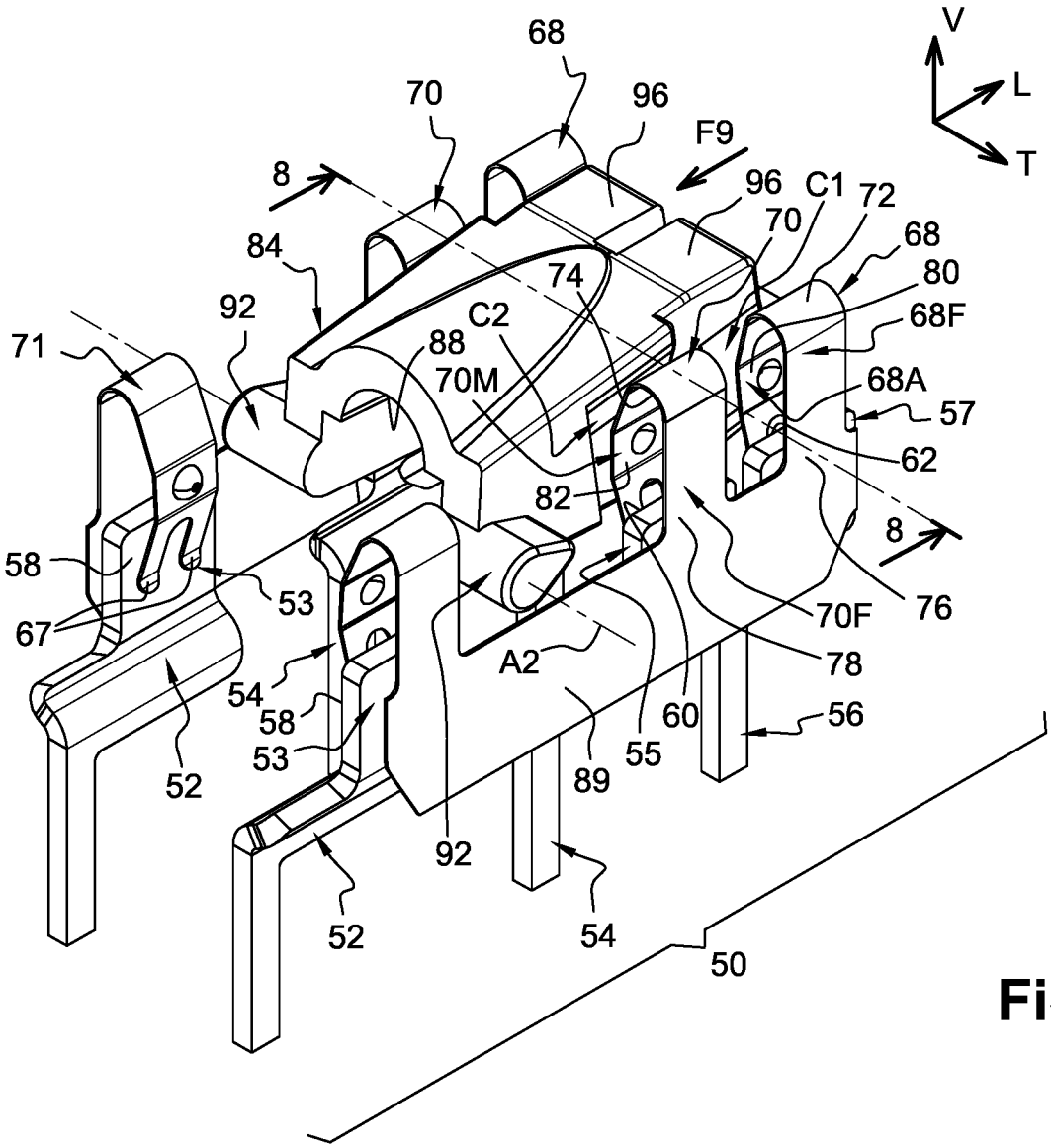
FIG. 5 is an enlarged perspective view of the fixed and movable contact elements in association with the tilting driving member in its upper position.
Figure 9:
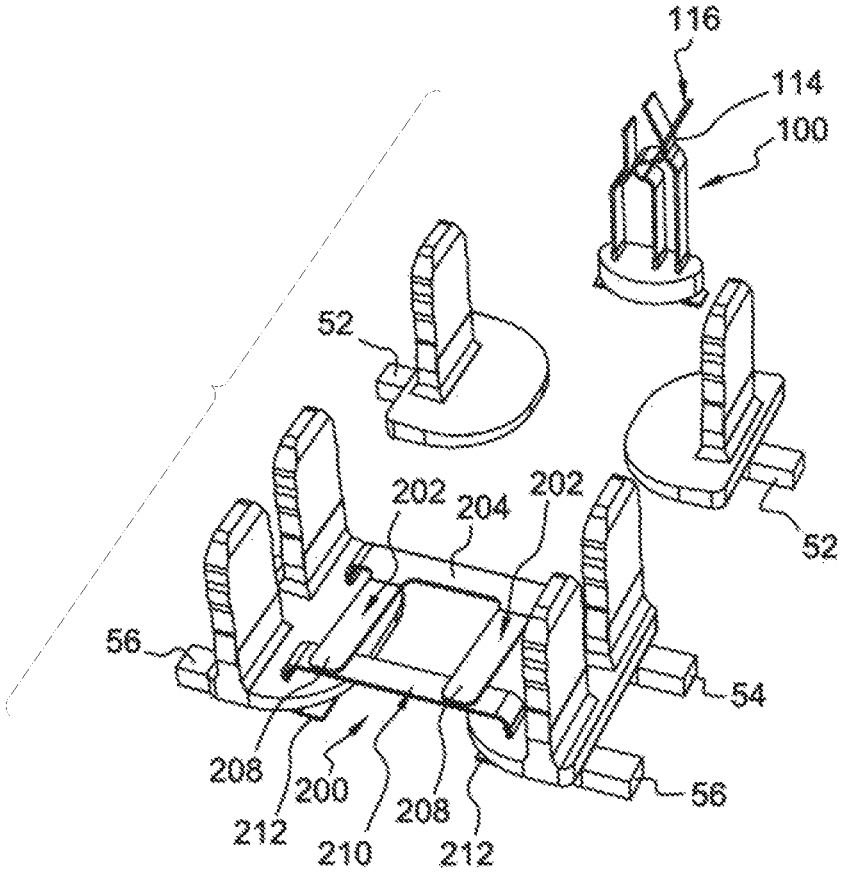
FIG. 9 is a perspective view showing the various fixed contacts of the snap switch and the various contact blades of the sensing switch and of the detecting switch.

Each contacting plate 53, 55, or 57 defines a fixed contact face 58, 60 and 62 respectively that is oriented inwardly. As it can be seen at FIGS. 3, 5 and 9, on each lateral side, the fixed contact faces 60 and 62 extend substantially in the same vertical and longitudinal plane.

The lower part 14 of the housing 12 is a plastic piece over molded on the fixed contacts 50 and each fixed contact includes a tail extending vertically outwardly for the electrical connection of the fixed contacts and of the snap switch 10, in a known manner, for instance on the upper face of a printed circuit board. Each one of the first or second fixed contact zones 57-62 or 55-60 is associated with a first 64 and respectively a second 66 movable contact arranged transversely facing the associated fixed contact zone.

The first movable contact 64 is a movable portion, in the form of a fork, of a first elastically deformable conductive blade 68 supported by the lower part 14 of the housing 12. The second movable contact 66 is a movable portion, in the form of a fork, of a second elastically deformable conductive blade 70 supported by the lower part 14 of the housing 12. Each deformable contact blade 68, 70 is the form of a cut and bent sheet of conductive metal having a general shape of a hairpin.

Each deformable contact blade 68, 70 includes two vertically oriented and globally parallel branches among which a fixed branch 68F, 70F and an active branch 68A, 70A, both being connected by a 180° upper bent portion 72, 74 extending between the adjacent upper ends of the two branches 68F-68A and 70F-70A. The vertically upwardly extending fixed branch 68F, 70F has a lower end 76, 78 fixed to the housing lower part 14.

Each downwardly extending active branch includes an upper bent portion (or cam follower portion) 80, 82 having its convexity transversely and inwardly oriented that constitutes a cam follower portion in the sense of the disclosure, and a lower bent free end portion 64, 66 having its convexity transversely and outwardly oriented that constitutes the movable contact portion in the sense of the disclosure.

Each lower end 76, 78 of a fixed branch 68F, 70F is vertically inserted (forced fit) and fixed in a receiving portion of the lower part 14 of the housing 12. On each side, the lower ends 76, 78 of two adjacent fixed branches 68F, 70F are connected together by a longitudinal and vertical band 89.

In a free state, i.e., when they are not elastically deformed, the design of each blade 68, 70 is such that there is a play or gap between a movable contact portion 64, 66 and its associated and facing face 62, 60 of the corresponding fixed contact plate 57, 55. Each blade 68, 70 is deformable, under a transversal and horizontal pressure acting on the cam portion 80, 82, starting from its free non-active state towards a deformed and active in which the movable contact portion 64, 66 is in electrically conductive contact with a facing and associated fixed contact face 62, 60.

The two adjacent deformable blades 68 and 70 have a common output in the form of the band 89 that is also the lower connecting part for a permanent fixed contacting third blade 71. Each third blade 71 is generally designed and shaped as the deformable active blades 68 and 70, but it has its lower free end portion 67 permanently in electrical contact with the contact face of the third contact plate 53.

Consequently, the deformable blades 68 and 70 are electrically connected to the fixed contact 52. When the first movable contact portion 64 is deformed and is in its active state for establishing a first conductive way, the contact 56 is electrically connected to the contact 52. When the second movable contact portion 66 is deformed and is in its active state for establishing a second conductive way, the contact 54 is electrically connected to the contact 52.

With a view to control the change of state of the movable contact portions 64 and 66, the second component of the movable assembly of the snap switch 10 is a tilting, or rocking or swaying driving member 84 that is part of a snap-action switching mechanism. The driving member 84 is pivotally mounted with respect to the housing 12 around a horizontal axis A2, and a traction spring 86. The driving member 84 is here a non-conductive plastic molded component in the form of a longitudinal yoke delimiting an internal longitudinal funnel 88 for receiving the traction spring 86.

The driving member 84 is delimited by two opposed lateral longitudinal and vertical driving faces 90. At its longitudinal end close to the actuating portion 28 of the pushbutton 18, the driving element 84 includes two aligned convex fulcrum portions that extend transversely. Each fulcrum portion 92 is received in a complementary concave portion formed in the housing 12 for pivotally mounting the driving member 84 with respect to the housing 12 around a horizontal and transversal axis A2.

The driving member 84 includes a transverse stem shaped transverse portion 94 for hooking one end of the traction spring 86. The traction spring 86 has a first end 85 operatively connected to the portion 46 of the actuating portion 28 of the pushbutton, and a second opposed end 87 hooked to the portion 94 of the driving member 84. The traction spring 86 is a helicoidally wound traction spring.

Figure 4:
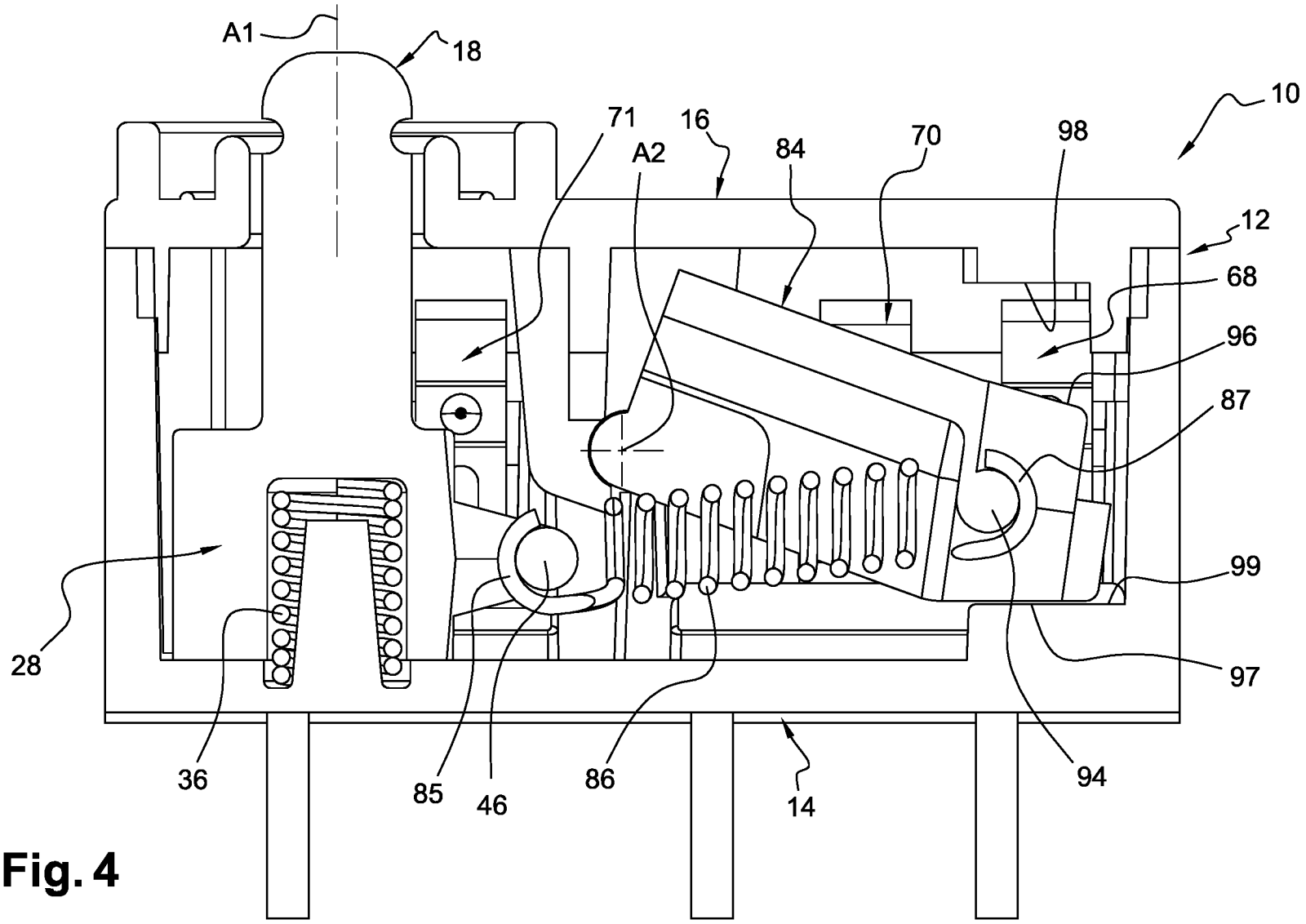
FIG. 4 is a cross-sectional view analogous to FIG. 3 showing the components in their lower position.

Due to the various geometrical parameters and dimensions, and under the action of the traction spring 86 and of the return spring 36, the driving unit 84 and the pushbutton 18 are all normally in their "upper" rest positions illustrated at FIG. 4. This upper position is defined by the cooperation between an upper face portion 96 of the driving member with an internal facing portion 98 of the upper cover part 16.

Figure 10:
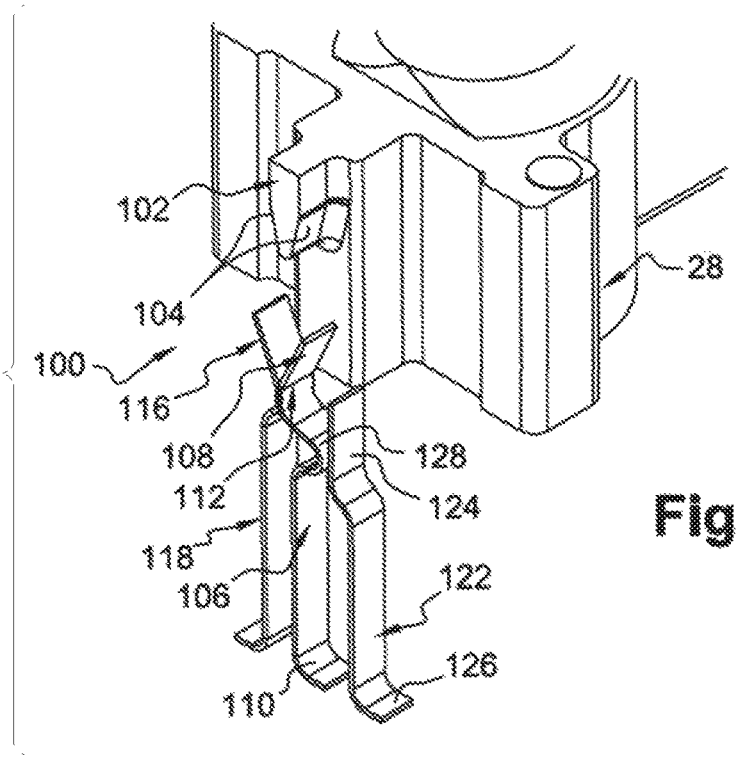
FIG. 10 is a detailed enlarged view of FIG. 6 showing the sensing switch.
Figure 11:
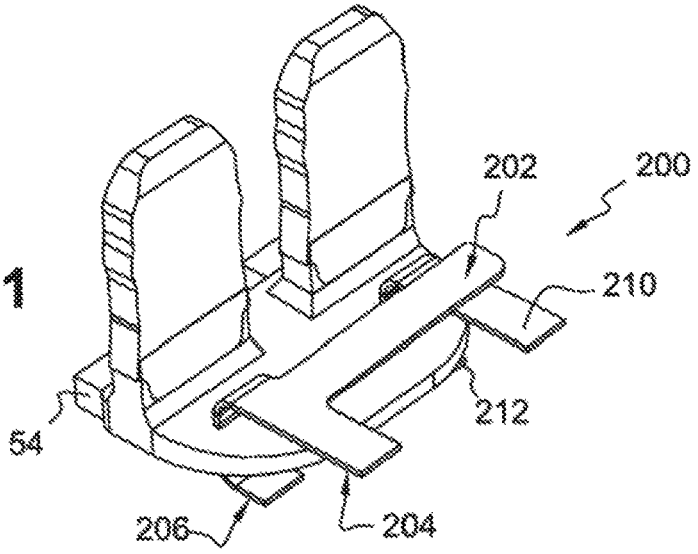
FIG. 11 is cross sectional half view showing at an enlarged scale the components of the detecting switch of FIG. 9.

When the users pushes downwardly on the stem 22 of the pushbutton, the actuating portion 28 of the pushbutton 18 acts, by means of the portion 46, on the first end 85 of the traction spring 86 to provoke the pivoting of the driving member 84, around the fixed horizontal axis A2, towards its second "lower" position illustrated at FIG. 10. This lower position is defined by the cooperation between a lower face portion 97 of the driving member 84 with an internal facing portion 99 of the lower part 14 of the housing 12.

For selectively acting on the deformable blades 68 and 70, each lateral driving face 90 here comprises two adjacent protruding driving cams, i.e., a first cam C1 and a second cam C2. The first cam C1 is dimensioned and designed for cooperating with the cam follower portion 82 of the first deformable blade 68. When the driving member 84 is in its upper position (in which the first end of the traction spring is in an upper spring position), the first cam C1 is permanently acting on the associated first cam follower portion 80 and the first conductive way is established. When the driving member 84 is in its lower position (in which the first end of the traction spring is in a lower spring position), the first cam C1 is no longer acting on the first cam follower portion 80 and the first conductive way is no longer established.

The second cam C2 is dimensioned and designed for cooperating with the second cam follower portion 82 of the second deformable blade 70. When the driving member 84 is in its upper position, the second cam C2 is not acting on the second cam follower portion 82 and the second conductive way is not established. When the driving member 84 is in its lower position, the second cam C2 is permanently acting on the associated second cam follower portion 82 and the first conductive way is established. Thus, a pivoting of the driving member from its upper active position towards its lower active position provokes a simultaneous change of state of the first conductive way (passing from an "ON" status to an "OFF" status) and of the second conductive way (passing from an "OFF" status to an "ON" status).

When the users pushes downwardly on the stem 22 of the pushbutton, the actuating portion 28 of the pushbutton 18 acts to pivot the driving member 84 from its upper position to its second lower. This change of position provokes the switching, i.e., the simultaneous interruption of the two first conductive ways—between the fixed contacts 52 and 56, and the subsequent simultaneous establishment of the two second conductive ways between the fixed contacts 52 and 54. It also provokes the compression of the return spring 36.

When the user releases its actuation effort on the stem 22, the previously compressed return spring 36 acts upwardly on the pushbutton 18 to push it vertically and upwardly. The actuating portion 28 of the pushbutton 18 acts to pivot the driving member 84 from its lower to its upper. Depending on the upper or lower position of the driving member 84, each cam cooperates, or not, with an associated cam follower portion of an associated elastically deformable blade to deform, or to relax, the blade for establishing or interrupting the associated conductive way.

This switch is primarily used in the automotive industry for actuation of an electronic parking brake. This switch may be also used in many applications including automotive air-bag systems as the system shut off switch. This switch can be used in any electronics application that, for instance, requires a double pole double throw circuit particularly if fast switching of both poles is desired.

According to the disclosure, it might be desirable to provide such a switch with additional or complementary detection function(s) concerning the actual movement and positions of the push button actuation member and/or of the tilting driving member, during the mechanical and electrical operation of the snap switch.

To this end, the present disclosure proposes to incorporate electrical switching means for generating signals representative of changes of position of the pushbutton 18 and/or of the driving member 84 of the mechanical movable assembly of the electrical snap switch 10.

Without globally modifying the previously described design, the snap switch 10 is here provided both with a front sensing switch 100 associated with the actuation portion 28 of the pushbutton 18, and with a rear detecting switch 200 associated with the tilting driving member 84.

The sensing switch comprises an activator, or actuator, 102 that is a longitudinal prong of the actuating portion 28 that extends longitudinally and configured as the shape of a triangular cam having two opposed lateral cam surfaces 104 forming a "V". The actuator 102 is integrally formed by molding with the actuating portion 28 and consequently moves vertically together with the pushbutton 18 between its two opposed and extreme upper and lower positions.

The sensing switch 100 also comprises an elastically deformable conductive sensing blade 106 adapted to cooperate with the actuator 102, depending on the vertical position of the pushbutton 18 and of the actuator 102 with respect to the sensing blade 106.

The sensing blade 106 extends vertically and is vertically aligned under the cam shaped portion of the actuator 102. The sensing blade 106 comprises an upper bent free actuation portion 108 for cooperation with the actuator 102, and a lower terminal end 110 supported (by potting and overmolding) by the horizontal lower face of the housing 10 that also supports the fixed contacts 52, 54 and 56.

Figure 6:
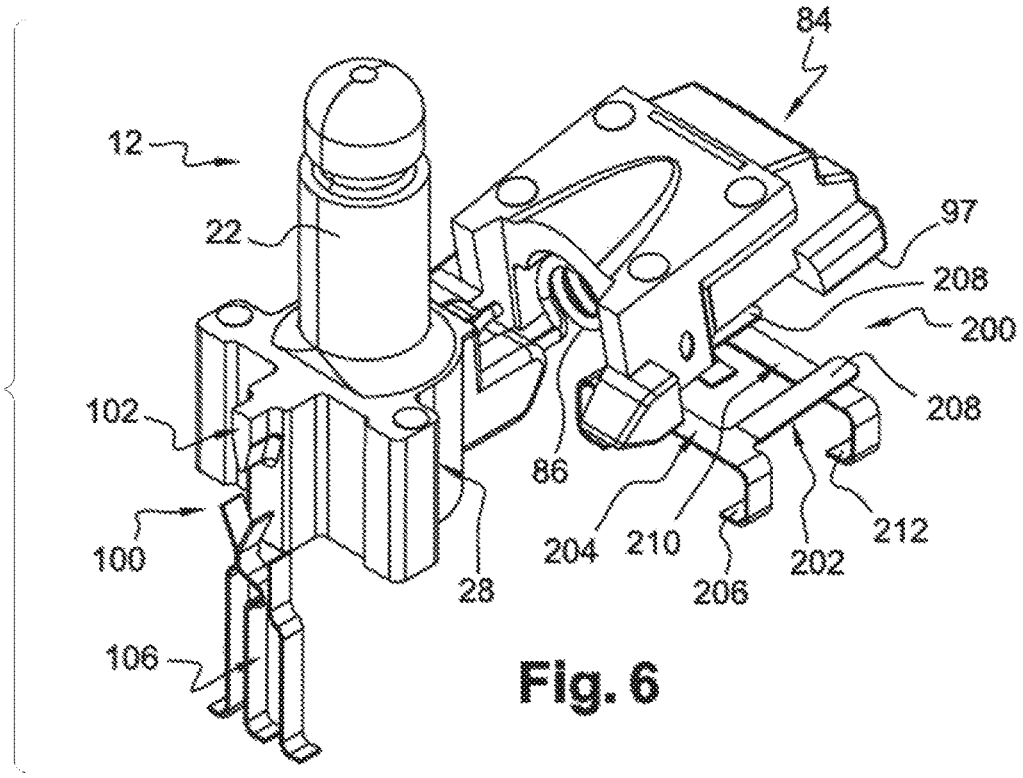
FIG. 6 is a perspective view of some of the components of a snap switch of the type illustrated at FIGS. 1 to 5 and that, according to various aspects of the disclosure, incorporates both a sensing switch for sensing the changes of position of the pushbutton, and a detecting switch for detecting the changes of position of the tilting driving member.
Figure 7:
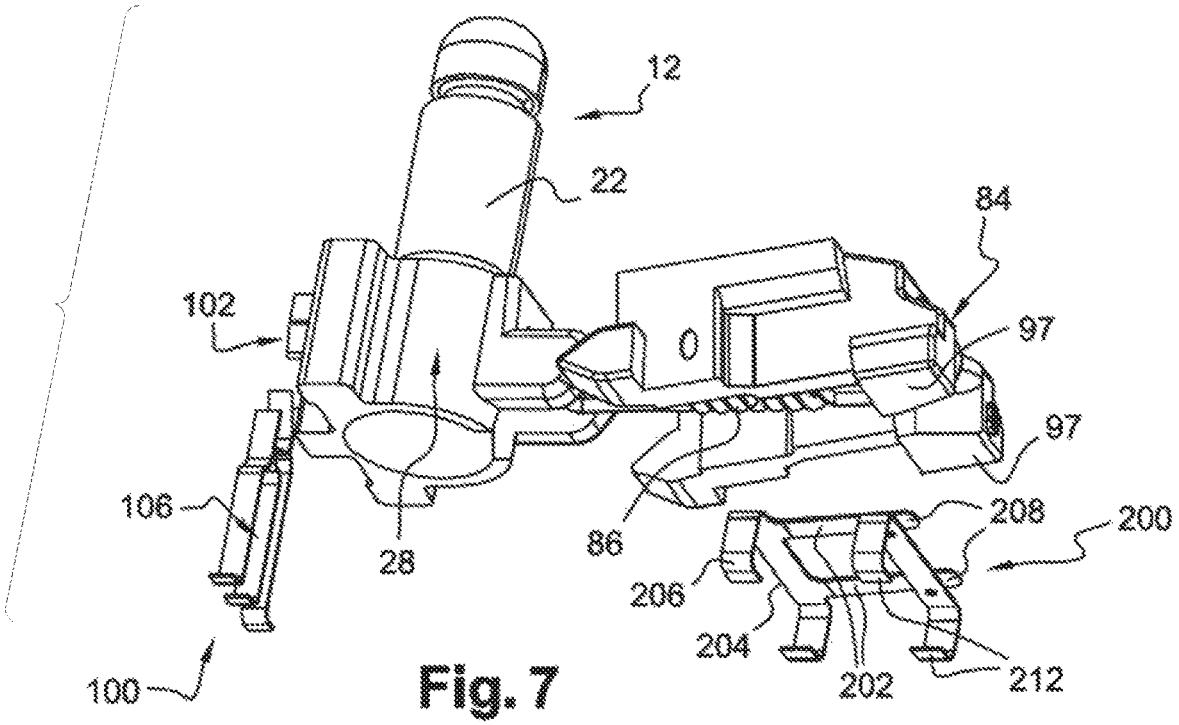
FIG. 7 is view similar to the view of FIG. 6, according to another angle of perspective.
Figure 8:
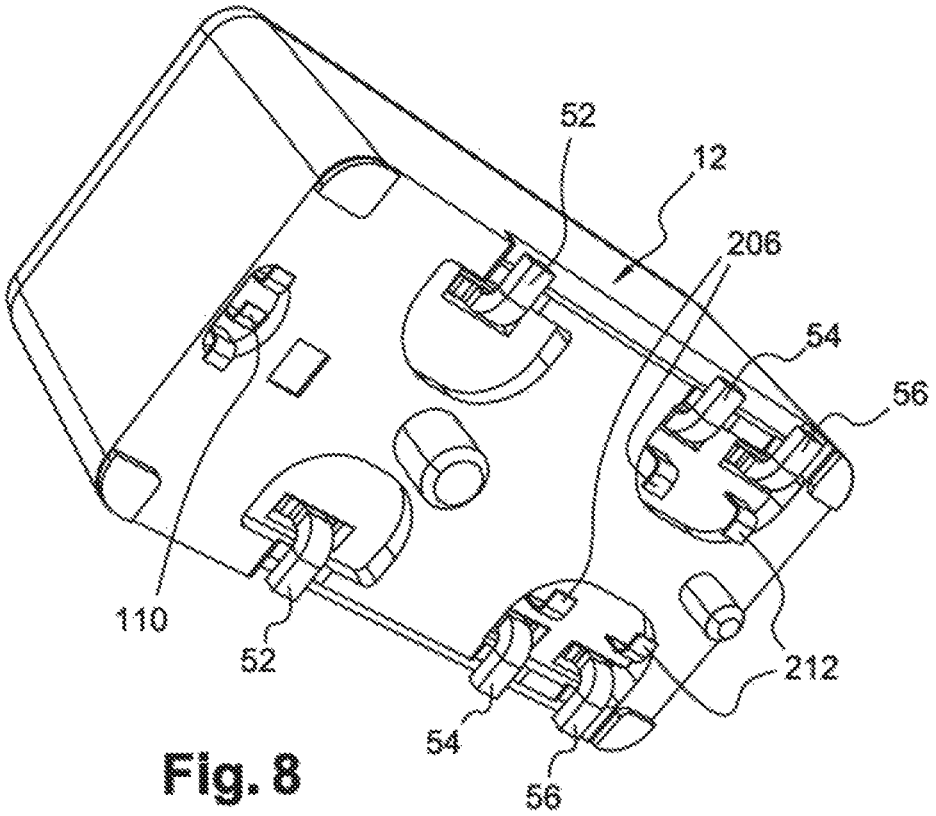
FIG. 8 is an under perspective view of the housing of the switch of FIGS. 6 and 7 showing the connection terminals of the various contact blades of the sensing switch and of the detecting switch.

The sensing blade 106 is movable between a rest position associated with the pushbutton upper position (illustrated at FIG. 3)—this rest position being illustrated at FIGS. 6, 7 and 10, and a non-illustrated active position associated with the pushbutton lower position (illustrated at FIG. 4).

The summit 112 of the bent portion 108 of the sensing blade 106 cooperates with a facing symmetrical and complementary summit 114 of a free end bent portion 116 of an adjacent and parallel "fixed" blade 118. The fixed blade 118 includes an upper bent free actuation portion 116 and a lower terminal end 120 supported (by potting and over-molding) by the horizontal lower face of the housing 10 that also supports the fixed contacts 52, 54 and 56.

When the push button is in its upper position, the two blades 106 and 118 are in electrical contact thus establishing an "ON" first switching way of the sensing switch 100. When the push button is in its lower position, the activator separates the upper bent portions 108 and 116 and the first switching way between the terminal ends 110 and 120 is "OFF". Thus the sensing switch provides with information reflecting the actual vertical position of the pushbutton 18 and of the actuating portion 28.

The sensing switch 100 also includes an additional second switching way that is turned "OFF" when the first switching way is turned "ON" and that is ON when the first switching way is "OFF". This is realized by means of another "fixed" blade 122 having an upper bent portion 124 and a lower terminal end 126. The blade 122 is parallel and adjacent to the sensing blade 106. The sensing blade 106 comprises a vertically intermediary shoulder 128 that cooperates with the bent portion of the blade 122 for establishing or interrupting an electrical connection between these two blades and between the end terminals 110 and 126.

By precisely designing the shapes and the altitudes of the various electrically cooperating portions, 116, 112, 128 and 124, it is also possible to determine a sequence for the changings of the two switching ways thus for example permitting to detect the sense of travel of the actuating portion 28 between its two opposed vertical positions.

The detecting switch 200 includes an activator movable with the tilting driving member 84 that is here the lower face portion 97 of the tilting driving member 84. The detecting switch 200 also includes two parallel elastically deformable conductive detecting blades 202. Each detecting blade 202 extends longitudinally from front to rear, being connected to a connecting portion 204 that has two end terminals 206 supported (by potting and over-molding) by the horizontal lower face of the housing 10 that also supports the fixed contacts 52, 54 and 56.

Each detecting blade 202 has a longitudinal free end 208 portion and each detecting blade can be elastically deformed downwardly by acting on the free end portion 208 by means of a lower face portion 97 of the tilting driving member 84. Each free end portion is also facing a corresponding portion of a transversal and horizontal fixed contact blade 210 that has two end terminals 212 supported (by potting and over-molding) by the horizontal lower face of the housing 10 that also supports the fixed contacts 52, 54 and 56.

Figure 12:
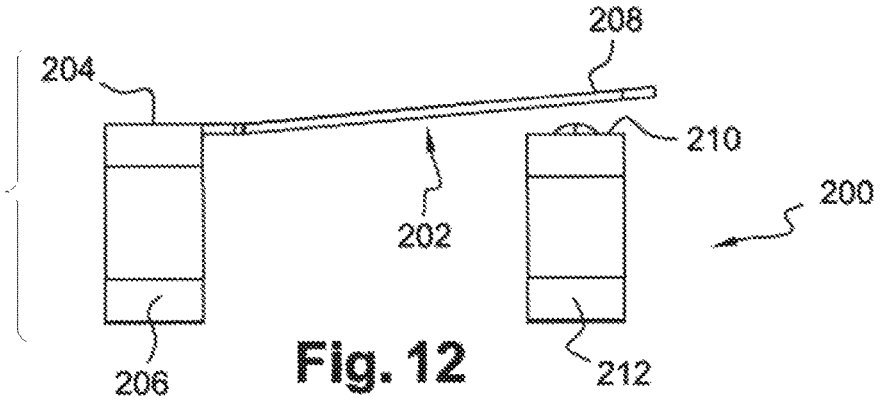
FIG. 12 is a detail lateral view showing the various blades of the detecting switch.

As it can be seen at FIG. 12, when the tilting driving member is in its upper position (illustrated at FIG. 3), the detecting blades 202 are in their rest position with a gap between the free end portions 208 and the facing fixed blade 210. Consequently, the detecting switching way between the end terminals 206 and 212 is turned "OFF". When the tilting driving member is in its lower position (illustrated at FIG. 4), the detecting blades 202 are elastically deformed by the lower face portions 97 and they are in electrical contact with the transversal fixed blade 210, thus establishing the detecting switching way "ON".

Other advantages of the present disclosure can be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications that are within the scope and spirit of the disclosure as defined in the claims.

The invention claimed is:

1. An electrical snap switch comprising:

a housing having a receiving portion;

an actuation member in the form of a pushbutton comprising an actuating portion formed by an extension extending into the housing, the pushbutton being arranged, when an external force is applied to the pushbutton, to be moved vertically relative to the housing between a pushbutton upper position and a pushbutton lower position;

at least a first pair of associated contact elements comprising a first fixed contact element provided in the receiving portion, and further comprising a first movable contact element that may come into contact with the first fixed contact element for establishing a first conductive way between the first movable contact element and the first fixed contact element;

at least a second pair of associated contact elements comprising a second fixed contact element provided in the receiving portion, and further comprising a second movable contact element that may come into contact with the second fixed contact element for establishing a second conductive way between the second movable contact element and the second fixed contact element; and a snap-action switching mechanism comprising a tilting driving member that is pivotally mounted with respect to the housing around a horizontal axis, and further comprising a spring that is connected to a part of the driving member and that cooperates with the actuating portion to move the driving member pivotally between an upper position and a lower position, wherein the pushbutton and the tilting driving member form a movable mechanical assembly, and further wherein, for generating signals representative of changes of position of the pushbutton that are independent of signals representative of the establishment, or not, of the first conductive way and of the establishment, or not, of the second conductive way, the electrical snap switch comprises a sensing switch, the sensing switch comprising additional contact elements for sensing the changes of position of the pushbutton between the pushbutton upper position and the pushbutton lower position, the sensing switch comprising an actuator movable with the actuating portion and at least one elastically deformable conductive sensing blade, the actuator being adapted to act on the sensing blade, and, for generating signals representative of changes of position of the driving member that are independent of signals representative of the establishment, or not, of the first conductive way and of the establishment, or not, of the second conductive way, the electrical snap switch comprises a detecting switch, the detecting switch comprising additional contact elements for detecting the changes of position of the tilting driving member between its upper position and its lower position, the detecting switch comprising an activator movable with the tilting driving member and at least one elastically deformable conductive detecting blade, the activator being configured to act on the detecting blade.

2. The electrical snap switch according to claim 1, wherein, under the action of the actuator, the sensing blade is movable between a rest position associated with the pushbutton upper position and an active position associated with the pushbutton lower position.

3. The electrical snap switch according to claim 2, wherein the change of position of the sensing blade provokes a change of state of a first switching way of the sensing switch.

4. The electrical snap switch according to claim 3, wherein the change of position of the sensing blade provokes, simultaneously or consecutively, a change of state of the first switching way and a change of state of a second switching way of the sensing switch.

5. The electrical snap switch according to claim 1, wherein the actuator is a cam shaped portion of the actuating portion.

6. The electrical switch according to claim 1, wherein the sensing blade extends vertically and comprises an upper free actuation portion for cooperation with the actuator, and a lower terminal end supported by the housing.

7. The electrical snap switch according to claim 1, wherein, when under the action of the activator, the detecting blade is movable between a rest position associated with the tilting driving member upper position and an active position associated with the tilting driving member lower position.

8. The electrical snap switch according to claim 7, wherein, during operation, the change of position of the detecting blade provokes a change of state of a detecting switching way of the detecting switch.

9. The electrical switch according to claim 1, wherein the detecting blade extends globally horizontally and comprises a longitudinal activation portion for cooperation with the activator, and a terminal end supported by the housing.

10. The electrical switch according to claim 1, wherein the activator is a portion of a lower face of the tilting driving member.

11. The electrical snap switch according to claim 1, wherein the actuating portion of the push button is vertically and slidably guided with respect to the housing, along a vertical actuation axis, and the tilting driving member is pivotally mounted with respect to the housing around a geometrical horizontal pivoting axis that is fixed with respect to the housing.

12. An electrical snap switch comprising:

a housing having a receiving portion;

an actuation member in the form of a pushbutton comprising an actuating portion formed by an extension extending into the housing, the pushbutton being arranged, when an external force is applied to the pushbutton, to be moved vertically relative to the housing between a pushbutton upper position and a pushbutton lower position;

at least a first pair of associated contact elements comprising a first fixed contact element provided in the receiving portion, and further comprising a first movable contact element that may come into contact with the first fixed contact element for establishing a first conductive way between the first movable contact element and the first fixed contact element;

at least a second pair of associated contact elements comprising a second fixed contact element provided in the receiving portion, and further comprising a second movable contact element that may come into contact with the second fixed contact element for establishing a second conductive way between the second movable contact element and the second fixed contact element; and a snap-action switching mechanism comprising a tilting driving member that is pivotally mounted with respect to the housing around a horizontal axis, and further comprising a spring that is connected to a part of the driving member and that cooperates with the actuating portion to move the driving member pivotally between an upper position and a lower position, wherein the pushbutton and the tilting driving member form a movable mechanical assembly, and further wherein, for generating signals representative of changes of position of the pushbutton that are independent of signals representative of the establishment, or not, of the first conductive way and of the establishment, or not, of the second conductive way, the electrical snap switch comprises a sensing switch, the sensing switch comprising additional contact elements for sensing the changes of position of the pushbutton between the pushbutton upper position and the pushbutton lower position, the sensing switch comprising an actuator movable with the actuating portion and at least one elastically deformable conductive sensing blade, the actuator being adapted to act on the sensing blade.

13. The electrical snap switch according to claim 12, further comprising, for generating signals representative of changes of position of the driving member that are independent of signals representative of the establishment, or not, of the first conductive way and of the establishment, or not, of the second conductive way, a detecting switch, the detecting switch comprising additional contact elements for detecting the changes of position of the tilting driving member between its upper position and its lower position, the detecting switch comprising an activator movable with the tilting driving member and at least one elastically deformable conductive detecting blade, the activator being configured to act on the detecting blade.

14. The electrical snap switch according to claim 12, wherein, under the action of the actuator, the sensing blade is movable between a rest position associated with the pushbutton upper position and an active position associated with the pushbutton lower position.

15. The electrical snap switch according to claim 14, wherein the change of position of the sensing blade provokes a change of state of a first switching way of the sensing switch.

16. The electrical snap switch according to claim 15, wherein the change of position of the sensing blade provokes, simultaneously or consecutively, a change of state of the first switching way and a change of state of a second switching way of the sensing switch.

17. An electrical snap switch comprising:

a housing having a receiving portion;

an actuation member in the form of a pushbutton comprising an actuating portion formed by an extension extending into the housing, the pushbutton being arranged, when an external force is applied to the pushbutton, to be moved vertically relative to the housing between a pushbutton upper position and a pushbutton lower position;

at least a first pair of associated contact elements comprising a first fixed contact element provided in the receiving portion, and further comprising a first movable contact element that may come into contact with the first fixed contact element for establishing a first conductive way between the first movable contact element and the first fixed contact element;

at least a second pair of associated contact elements comprising a second fixed contact element provided in the receiving portion, and further comprising a second movable contact element that may come into contact with the second fixed contact element for establishing a second conductive way between the second movable contact element and the second fixed contact element; and a snap-action switching mechanism comprising a tilting driving member that is pivotally mounted with respect to the housing around a horizontal axis, and further comprising a spring that is connected to a part of the driving member and that cooperates with the actuating portion to move the driving member pivotally between an upper position and a lower position, wherein the pushbutton and the tilting driving member form a movable mechanical assembly, and further wherein, for generating signals representative of changes of position of the driving member that are independent of signals representative of the establishment, or not, of the first conductive way and of the establishment, or not, of the second conductive way, the electrical snap switch comprises a detecting switch, the detecting switch configured to move independently from the first movable contact element and the second movable contact element, comprising additional contact elements for detecting the changes of position of the tilting driving member between its upper position and its lower position, the detecting switch comprising an activator movable with the tilting driving member and at least one elastically deformable conductive detecting blade, the activator being configured to act on the detecting blade.

18. The electrical snap switch according to claim 17, wherein, when under the action of the activator, the detecting blade is movable between a rest position associated with the tilting driving member upper position and an active position associated with the tilting driving member lower position.

19. The electrical snap switch according to claim 18, wherein, during operation, the change of position of the detecting blade provokes a change of state of a detecting switching way of the detecting switch.

20. The electrical switch according to claim 17, wherein the detecting blade extends globally horizontally and comprises a longitudinal activation portion for cooperation with the activator, and a terminal end supported by the housing.

* * * * *